United States Patent [19]

Glenn

[11] 4,245,954

[45] Jan. 20, 1981

[54] CERAMIC TURBINE STATOR VANE AND SHROUD SUPPORT

[75] Inventor: Robert G. Glenn, Lower Moreland Township, Montgomery County, Pa.

[73] Assignee: Westinghouse Electric Corp., Pittsburgh, Pa.

[21] Appl. No.: 965,556

[22] Filed: Dec. 1, 1978

[51] Int. Cl.[2] ..... F01D 9/04

[52] U.S. Cl. ..... 415/200; 415/217

[58] Field of Search ..... 415/200, 212 A, 216, 415/217, 218, 139

[56] References Cited

U.S. PATENT DOCUMENTS

| | | | |
|---|---|---|---|
| 2,488,875 | 11/1949 | Morley | 415/218 |
| 2,622,790 | 12/1952 | McLeod | 415/218 |
| 2,744,680 | 5/1956 | Rainbow et al. | 415/218 |
| 2,755,064 | 7/1956 | Simonsen | 415/218 |
| 2,801,822 | 8/1957 | Speed | 415/218 |
| 2,819,871 | 1/1958 | McVeigh | 415/216 |
| 2,957,228 | 10/1960 | Stoddard et al. | 415/217 |
| 3,325,087 | 6/1967 | Davis | 415/218 |
| 3,521,974 | 7/1970 | Zerlauth | 415/216 |

FOREIGN PATENT DOCUMENTS

| | | | |
|---|---|---|---|
| 523928 | 4/1955 | Italy | 415/217 |

*Primary Examiner*—Leonard E. Smith
*Attorney, Agent, or Firm*—E. F. Possessky

[57] ABSTRACT

A support system for supporting the stationary ceramic vanes and ceramic outer shrouds which define the motive fluid gas path in a gas turbine engine is shown. Each individual segment of the ceramic component whether a vane or shroud segment has an integral radially outwardly projecting stem portion. The stem is enclosed in a split collet member of a high-temperature alloy material having a cavity configured to interlock with the stem portion. The generally cylindrical external surface of the collet engages a mating internal cylindrical surface of an aperture through a supporting arcuate ring segment with mating camming surfaces on the two facing cylindrical surfaces such that radially outward movement of the collet relative to the ring causes the internal cavity of the collet to be reduced in diameter to tightly engage the ceramic stem disposed therein. A portion of the collet extends outwardly through the ring segment opposite the ceramic piece and is threaded for receiving a nut and a compression washer for retaining the collet in the ring segment under a continuous biasing force urging the collet radially outwardly.

9 Claims, 6 Drawing Figures

CERAMIC TURBINE STATOR VANE AND SHROUD SUPPORT

BACKGROUND OF THE INVENTION

1. Field of the Invention

This invention relates to ceramic stationary components for a gas turbine engine and more particularly to structure for mounting such ceramic components.

2. Description of the Prior Art

It is well known that the use of ceramic components within the path of the hot motive fluid in a gas turbine engine would permit the motive fluid to be at a higher temperature than presently available when such structure is fabricated from a high-temperature alloy material. Further, if cooling air is supplied to the structure to permit raising the temperature of the motive fluid beyond the temperature limitations of the material, it is apparent that because of the ability of ceramics to withstand the higher temperatures, less cooling fluid would be required when the components are fabricated from ceramic materials and thus the turbine efficiency would be improved.

However, as opposed to the high-temperature metal alloy material, ceramic components are quite brittle and therefore care must be taken in designing them to minimize stress concentrating features and providing a configuration which is relatively easily fabricated through the well-known isostatic densification process for producing generally fully dense high strength ceramics. Further, in mounting the ceramic components within a gas turbine, consideration must be given to mounting them in a manner to minimize vibrations. This is particularly true for the stationary components which, unless firmly held, will be vibrated by the force of the hot motive gas passing thereacross. The mounting structure must be able to accommodate distinct variations in the rate of expansion between the ceramics and the supporting elements, generally made of metal, due to their different temperatures and to their different coefficients of expansion. Thus, it is apparent that the mounting support for ceramic components must be unique to the ceramic and metal interface to satisfy these requirements.

U.S. Pat. No. 4,008,978 shows a gas turbine with ceramic components disposed in and forming the motive gas path; however, the support system for the components as shown therein is considerably different than the support for the components according to the instant invention.

SUMMARY OF THE INVENTION

This invention provides structure for mounting stationary ceramic components in the motive fluid flow path of a gas turbine engine. Such components generally comprise the stator vanes and the outer shroud. Each ceramic stator vane segment (e.g. one vane for each segment) and each ceramic shroud segment has, on its surface opposite the gas path, a radially outwardly projecting integral stem member having an initial oval periphery over a certain axial length and an inset intermediate cylindrical configuration which terminates in a dog-bone or dove-tail terminal end.

A plurality of arcuate intermediate metal (e.g. stainless steel) segments are mounted on the turbine casing in a well-known manner to form an annular array with each intermediate segment containing a plurality of openings extending radially therethrough defining generally cylindrical inner surfaces having an initial inner diameter larger than the inner diameter at an intermediate area therein with the two cylindrical surfaces defined thereby joined by a slanted ramp-like surface. A two-piece metal (e.g. high-temperature alloy) collet member (each half being a duplicate of the other along the longitudinal axis thereof) defines, when the two halves are assembled, an internal cavity conforming substantially to the configuration of the ceramic stem of the vane or shroud to engage and retain the stem therein. The external surface of the assembled collet defines a configuration conforming to the internal cylindrical wall configuration of the opening in the intermediate segment. A threaded portion of the collet projects radially outwardly from the opening in the intermediate segment and a compression spring washer and nut is placed thereon to jam against the outer face of the segment to place a normally radially outwardly biasing force on the collet. The mating tapered surfaces between the collet and the cylindrical wall configuration of the intermediate segment tend to compress the collet to close the internal cavity thereof causing the collet to tightly grip the ceramic stem. Any lengthening of the collet member due to expansion is accommodated by the spring washer to maintain the camming or compressing force between the collet and the intermediate segment to maintain the collet tightly engaging the ceramic stem. A compliant layer is interposed between all ceramic to metal facing surfaces providing lubricity therebetween. Cooling air passages are provided through the collet in that it is in face-to-face engagement with the relatively hot ceramic component, to maintain the metal temperature within its acceptable temperature range.

DESCRIPTION OF THE PREFERRED EMBODIMENT

Figure 1:
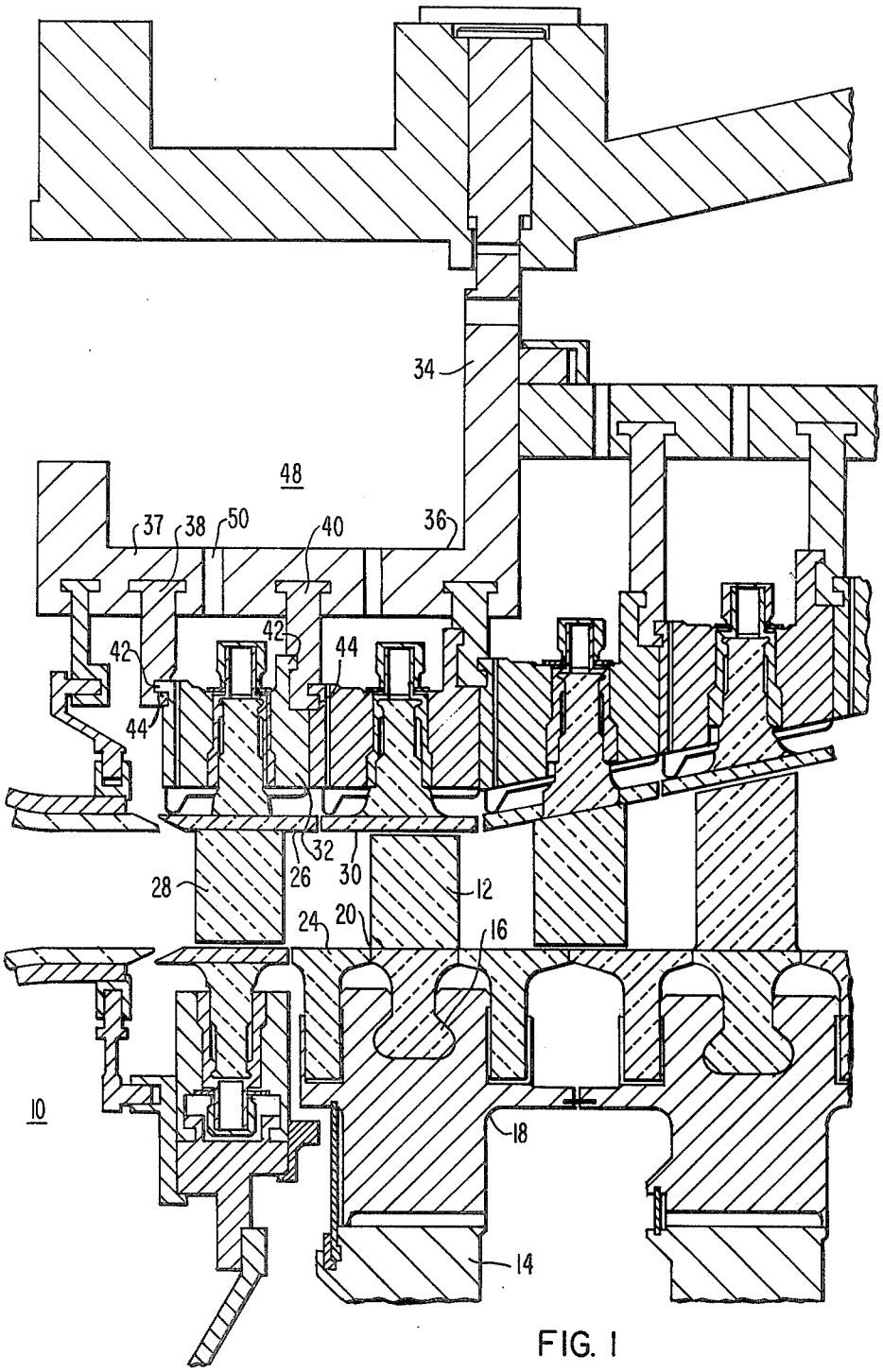
FIG. 1 is a cross-sectional elevational view of a portion of a gas turbine engine showing the hot motive fluid flow path and the ceramic vanes and outer shroud mounted in accordance with the present invention.

Referring to FIG. 1, a portion of the turbine section of a gas turbine engine 10 is shown. As therein seen, the turbine includes a plurality of rotor stages defined by blades 12 mounted on rotor discs 14 via any well-known method; however, in the instant embodiment, in that the turbine inlet temperature is to be relatively high (e.g. on the order of 2,000°+ F.) the blades 12 are preferably ceramic and mounted in a dovetail cavity 16 in an intermediate piece 18 of high-temperature alloy material which in turn is mounted in a fir tree root configuration to the disc 14. The blade platform 20 and the adjacent rotationally mounted (as in an axially open dovetail groove 22 in the intermediate piece 18) inner shroud segments 24 between blades, defines the inner boundary of the motive fluid flow path. In that this specific structure is not a part of the instant invention, any other suitable mounting structure can be employed for mounting the ceramic blades 12 and rotational inner shrouds 14 to the rotor disc.

The outer boundary of the motive fluid flow path is defined by the platform 26 of the stationary vanes 28, disposed between adjacent rotor stages, and the outer shroud 30, each of which is also fabricated from ceramic to withstand the temperature of the motive fluid.

The stationary ceramic vanes 28 and ceramic outer shrouds 30 are mounted in intermediate arcuate segments 32 in a particular manner that will be subsequently described in detail, however, the intermediate arcuate segments 32, which are fabricated of a high-temperature alloy, are mounted in the outer casing 34 of the gas turbine through generally well-known structure as shown in FIG. 1. Thus, a circumferential blade ring 36 is secured to the outer casing 34. Each blade ring includes an axially extending component 37 having "T"-shaped grooves 38 therein open to the inner face. "T"-shaped circumferentially extending isolation rings 40 are inserted in the grooves 38 with each two of axially adjacent isolation rings 40 having axially facing grooves 42 for receiving axially projecting flanges 44 in the arcuate segments 32. As is seen, cooling air from an appropriate stage in the compressor of the turbine can be bled into a chamber 48 formed between the blade ring 36 and the outer casing 34 with outlets 50 through the blade ring into each circumferential space defined by the adjacent opposed isolation ring and the intermediate segments 32.

Figure 2:
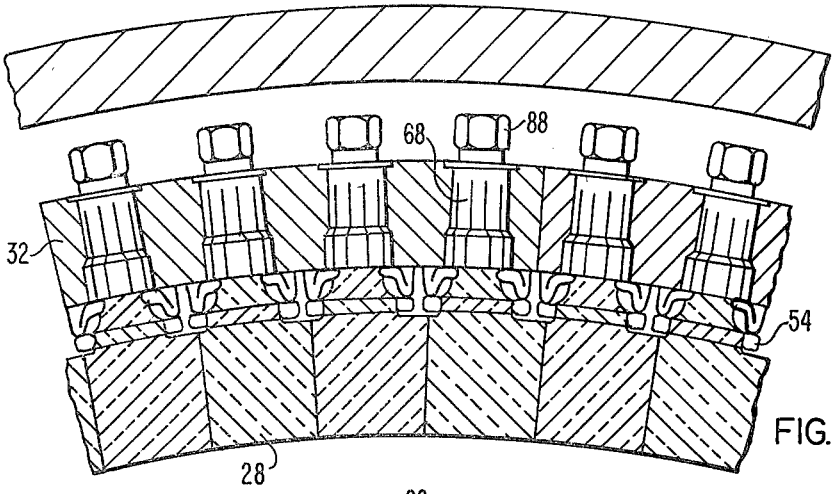
FIG. 2 is a cross-sectional view generally along line II—II of FIG. 1.

Reference is made to FIG. 2 to show that each individual arcuate intermediate segment 32 supports a plurality of either vanes 28 or outer shroud segments 30. In this particular instance, four such vanes 28 or 3 such shroud segments 30 are shown mounted in each intermediate piece 32.

It is to be understood that the particular structural relationship between the intermediate arcuate segment 32 and the ceramic piece (either 28 or 30) supported thereby is the same whether that ceramic piece is a shroud segment 30 or a vane 28. Thus, reference will be made to FIG. 3 for the particular structure which is shown supporting a vane 28, with the shroud 30 being generally identically supported.

Figure 3:
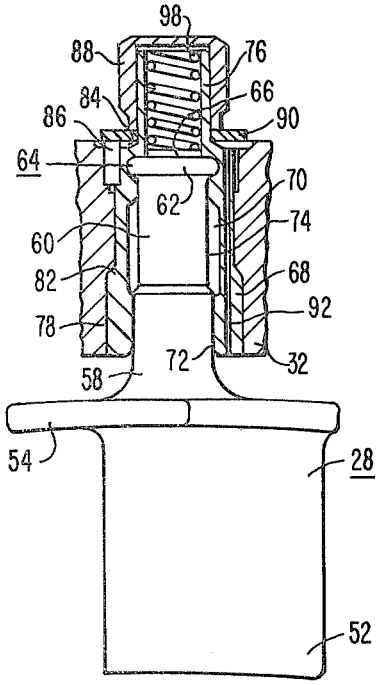
FIG. 3 is an enlarged cross-sectional view of the specific mounting structure of the present invention.

Referring to FIG. 3, the ceramic vane 28 is seen to include an airfoil portion 52 and a platform portion 54. A ceramic stem 56 extends radially outwardly from the platform portion 54 and is particularly configured to have a first portion 58, generally adjacent the platform, which, as will be discussed later, has an oval circumference. The first portion 58 terminates in a mid-portion 60 of substantially circular circumference of a reduced diameter, providing an inset portion, and the terminal end 62 of the stem 56 defines a generally dog-bone or dovetail configuration 64 terminating in an outwardly facing planar end 66.

A generally cylindrical collet member 68 defines a cavity 69 for receipt therein of the stem 56 in facing engagement with the oval first portion 58 thereof and in facing interlocking engagement with the dog-bone configured terminal end 64. The intermediate axial extent 70 of the collet cavity 69 has a larger internal diameter than the throat portion 72 which engages the oval circumference of the stem 56 to define a circumferential space 74 between the collet and the intermediate inset portion 60 of the stem. The collet 68 terminates in a radially outwardly projecting externally threaded portion 76 of reduced diameter.

Still referring to FIG. 3 it is seen that the collet 68 is disposed in an opening 78 complementary to the external configuration of the collet 68 and radially extending through the intermediate segment 32 with the threaded portion 76 projecting outwardly therefrom. The complementary facing outer cylindrical surface of the collet and the internal cylindrical surface of the opening 78 have facing engaging angled shoulder surfaces 80, 82 respectively so that axial movement of the collet to the left as viewed in FIG. 3 with respect to the intermediate segment 32 causes the angled surfaces 80, 82 to cam or force the internal opening or cavity 69 of the collet to a reduced diameter.

In that the outer surface of the collet 68 and the inner surface of the opening 78 through the intermediate segment 32 are circular, the end of the collet adjacent the radially outer surface of the segment 32 is notched, as is the adjacent surface of the segment as at 84, and a spring pin 86 is inserted into the space defined by the adjacent notches 84 to key the two components together in an indexed relationship and prevent turning of the collet 68 within the segment 32.

A compression or Bellville washer 90 (shown in a compressed state) is placed over the threaded end 76 of the collet is biased abutting relationship with the outermost face 93 of the intermediate member 32 and an internally threaded retaining nut 88 is screwed onto the threaded portion 76 of the collet to compress the washer 90 against the intermediate segment 32. As is evident, tightening of the nut 88 draws the collet 68 outward with respect to the segment 32 causing, via the camming surfaces 80, 82, the throat portion 72 of the collet cavity to tightly grip the initial portion of the stem 56. The collet contains axially extending slits 96 (more clearly shown in FIG. 4) to permit such reduction in its internal diameter.

Cooling air flow channels 92 extend radially through the collet 68 to permit cooling air to flow therethrough and maintain the temperature of the intermediate piece within an acceptable temperature range even though it is in intimate facing engagement with the relatively hot ceramic component.

Figure 4:
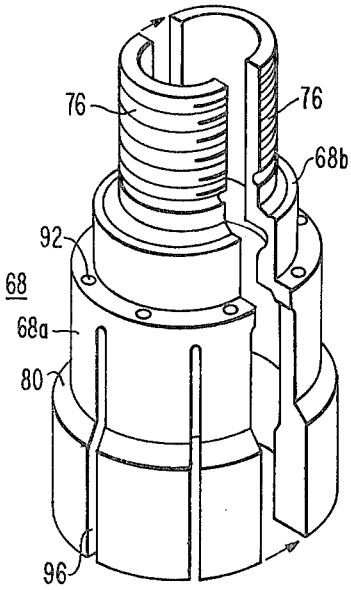
FIG. 4 is an isometric view of the collet member of the support of the instant invention.

As the dog-bone configuration on the stem 56 prevents axial insertion of the stem into the complementary configured collet cavity 69, it will be seen in FIG. 4 that the collet 68, in fact, is made of two separate pieces 68a and 68b each forming a radially extending one-half of the collet. The collet is thus placed over the ceramic stem portion 56 a piece at a time and then in such assembled relationship inserted into the opening in the segment 32.

Again referring to FIG. 3, it is seen that a compression spring 98 is disposed between the terminal face of the stem and the internal face of the nut 88 to normally bias the ceramic stem radially inwardly into tight interlocking arrangement between the complementary engaging dog-bone configuration. However, it is apparent that close tolerances between the two surfaces could also be maintained to eliminate the necessity for such spring.

Figure 5:
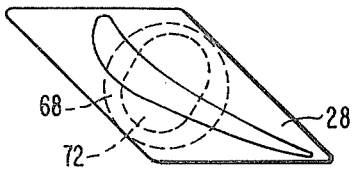
FIG. 5 is a cross-sectional view generally along line V—V of FIG. 3.

Reference is now made to FIG. 5 wherein the oval circumference 58 of the stem 56 is shown as engaged by the throat 72 of the collet 68. It is apparent that with this configuration, the ceramic piece, especially if it is a vane 28, is prevented from twisting or turning within the collet. Further, it is apparent from this view that the collet 68 is formed of two identical halves split axially along its extent.

Figure 6:
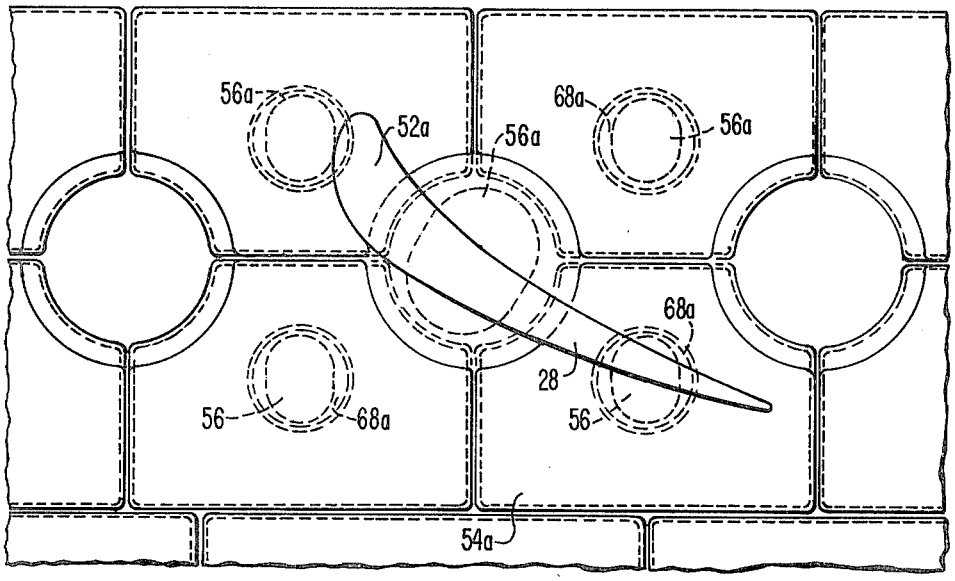
FIG. 6 is a view similar to FIG. 5 of another mounting pattern.

FIG. 6 is a view similar to FIG. 5; however, it is therein shown that, as an alternative to fabricating the vane into an integral airfoil and platform component, the airfoil portion 52*a* of the vane is made separate from the platform portion 54*a* and the platform portion 54*a* is segmented into quadrants. Thus, each quadrant includes a stem portion 56*a* projecting therefrom and the airfoil 52 also includes a stem portion 56*a* projecting therefrom for separate mounting of these components within the segment 32 in the manner previously described. However, in such configuration, the stem portion 56*c* for each ceramic platform 54*a* quadrant is reduced in cross-sectional area as compared with that for mounting the airfoil portion in that the stress thereon is considerably less and thus the mating collet 68*a* is also reduced in size. With this configuration the stress concentrating features of the integral ceramic vane (e.g. the corners at the juncture of the platform and airfoil portion) are reduced and most dissimilar shaped pieces are maintained separate so that variations in the rates of expansion caused by their dissimilar configuration do not produce stress within the ceramic component.

It is anticipated that all ceramic-to-metal engaging surfaces will have interposed therebetween a compliant layer such as is well known in the art for attaching ceramic to a metal surface. Thus, the throat area of the collet cavity 69 and that portion of the collet cavity 69 engaging the dog-bone configuration 64 of the stem 56 will have a thin (e.g. 5 mils) compliant layer thereon such as a platinum metal applied thereto as by plating, sputtering or flame spraying.

I claim:

1. In a gas turbine engine having ceramic components disposed in an annular array to define the path for the motive gas through the turbine including certain components defining the outer periphery of the gas flow path and means for mounting said certain components, said means comprising a plurality of arcuate segments forming an annulus, each segment having a radially extending opening therethrough defining a generally cylindrical inner wall having an initial inner diameter larger than a concentric inner diameter at an intermediate area and a tapered surface joining the two cylindrical walls, a two piece axially split collet member having, in assembled relationship, an external cylindrical surface generally conforming to the internal cylindrical wall of said opening including a tapered collar portion and projecting through the radially outermost end of said opening with said projection providing a threaded terminal end, said collet member further defining an internal cavity having an initial throat of oval circumference and a generally dog-bone configuration in the opposite end, and stem means integral with and extending from said ceramic piece for receipt within said cavity, said stem means defining an oval circumference corresponding to the oval throat portion and an enlarged terminal end conforming to the dog-bone cavity whereby said collet is disposed about said stem and inserted into said cylindrical opening, a nut threadably engaging said threaded end, a spring washer interposed between said nut and said segment biased to normally urge separation of said nut from said segment whereby tightening said nut onto said spring washer causes the tapered engaging surfaces of said segment and said collet to cam the collet into tight engagement with said stem of the ceramic piece and any axial lengthening of said collet with respect to said segment is accommodated by said spring washer to maintain a continuous camming force between said parts.

2. In a gas turbine engine having ceramic stationarily mounted vane components and ceramic stationarily mounted shroud components, means for mounting said ceramic components comprising:

a plurality of arcuate segments mounted to the turbine casing and forming an annular ring and wherein said segments contain at least one radially extending opening therethrough having a stepped configuration provided by two different internal diameters and providing a shoulder at the juncture thereof;

a two piece axially-split collet member having, in assembled form, an external stepped surface providing a shoulder, said surface generally conforming to the configuration of said opening and a portion projecting radially outwardly from said segment and wherein said assembled collet defines an internal cavity open at the radially inner surface and defining an initial throat section and terminating at the opposite end of an enlarged cavity;

a stem member integral with and extending generally radially from each said ceramic component and having a configuration generally conforming to said cavity for engaging receipt therein; and, means engaging said projecting portion of said collet member and urging said collet member generally outwardly with respect to said segment and forcing said engaging shoulders of said segment and said collet member into abutment.

3. Structure according to claim 2 wherein said initial throat section of said collet cavity and that portion of the stem engaged by said throat section are non-circular to prevent rotation of said stem within said cavity.

4. Structure according to claim 3 wherein said shoulder within said opening and said shoulder on the external surface of said collet are angled and in face-to-face contact such that said urging force on said collet by said engaging means provides a squeezing force on said collet for tight engagement of said stem portion.

5. Structure according to claim 4 including means interposed between said collet and said segment to prevent turning of said collet within said opening.

6. Structure according to claim 5 wherein said collet member includes cooling fluid passages from the radially outer surface of said segment to the radially inner surface of said segment.

7. Structure according to claim 6 including biasing means interposed between said collet and said stem to normally urge said stem radially outwardly from said collet to maintain a seating force on the interengaging surfaces between said cavity and said stem.

8. Structure according to claim 7 wherein said stem terminates in a dog-bone configuration mating with a like configuration forming said enlarged portion of said cavity and wherein the surface of said stem between said throat area and said dog-bone configuration is free from contact with said collet member.

9. Structure according to claim 8 wherein said collet member is a metal alloy and wherein a thin compliant layer is interposed between all ceramic-to-metal engaging surfaces.

* * * * *